US005556098A

United States Patent [19]

Higuchi et al.

[11] Patent Number: 5,556,098

[45] Date of Patent: Sep. 17, 1996

[54] THREE-PIECE SOLID GOLF BALL

[75] Inventors: Hiroshi Higuchi; Hisashi Yamagishi, both of Yokohama; Yoshinori Egashira, Hidaka; Tadatoshi Yamada, Mitaka, all of Japan

[73] Assignee: Bridgestone Sports Co., Ltd., Tokyo, Japan

[21] Appl. No.: 271,983

[22] Filed: Jul. 8, 1994

[30] Foreign Application Priority Data

Jul. 8, 1993 [JP] Japan ..... 5-193064

[51] Int. Cl.[6] ..... A63B 37/06

[52] U.S. Cl. ..... 473/373; 473/374

[58] Field of Search ..... 273/228, 230, 273/218, 220, 62, 217, 219

[56] References Cited

U.S. PATENT DOCUMENTS

| | | | |
|---|---|---|---|
| 4,650,193 | 3/1987 | Molitor et al. | 273/228 |
| 4,714,253 | 12/1987 | Nakahara et al. | 273/228 |
| 4,781,383 | 11/1988 | Kamada et al. | 273/228 |
| 5,048,838 | 9/1991 | Chikaraishi et al. | 273/228 |
| 5,184,828 | 2/1993 | Kim et al. | 273/228 |
| 5,253,871 | 10/1993 | Viollaz | 273/228 |

FOREIGN PATENT DOCUMENTS

| | | |
|---|---|---|
| 0264522 | 4/1988 | European Pat. Off. . |
| 2666018 | 2/1992 | France . |
| 2230531 | 10/1990 | United Kingdom . |

*Primary Examiner*—George J. Marlo
*Attorney, Agent, or Firm*—Sughrue, Mion, Zinn, Macpeak & Seas

[57] ABSTRACT

A three-piece solid golf ball comprising; a center core, an intermediate layer, and a cover enclosing the core through the intermediate layer, said center core formed of a polybutadiene base rubber and having a diameter of at least 26 mm, a specific gravity of less than 1.4, and a hardness up to 80 on JIS C scale, said intermediate layer formed of a thermoplastic polyester elastomer and having a thickness of at least 1 mm, a specific gravity of less than 1.2, and a hardness of less than 80 on JIS C scale, and said cover having a thickness of 1 to 3 mm, and a hardness of at least 85 on JIS C scale.

9 Claims, 1 Drawing Sheet

THREE-PIECE SOLID GOLF BALL

BACKGROUND OF THE INVENTION

1. Field of the Invention

This invention relates to three-piece solid golf balls which are improved in feeling without sacrificing flying performance and durability.

2. Prior Art

Golf balls of various structures are currently on the market. Among others, two-piece solid golf balls and thread-wound golf balls share the majority of the market. The two-piece solid golf ball has a rubber based core and an enclosing cover typically of ionomer resin while the thread-would golf ball is produced by winding thread rubber around a solid or liquid center and enclosing the center in a cover.

Most amateur golfers are fond of two-piece solid golf balls which have excellent flying performance and durability although these balls have the disadvantages of a very hard feel on hitting and low control due to rapid ball separation on striking. For this reason, many of professional golfers and skilled amateur golfers prefer wound golf balls to two-piece solid golf balls. The wound golf balls are superior in feeling and control, but inferior in flying distance and durability to the two-piece solid golf balls.

Under the present situation that two-piece solid golf balls and wound golf balls have contradictory characteristics as mentioned above, players make a choice of golf balls depending on their own skill and taste.

In order to develop solid golf balls having a hitting feel approximate to the wound golf balls, two-piece solid golf balls of soft type have been considered. For such two-piece solid golf balls of soft type, soft cores must be used. If the cores are soft, however, repulsion becomes low with a concomitant loss of flying performance and durability is considerably deteriorated. That is, the superior flying performance and durability which are characteristic of two-piece solid golf balls are lost, and in an extreme case, the balls become unacceptable for practical use. Stated differently, since conventional two-piece solid golf balls have the structure which is determined by optimizing three parameters, softness, repulsion and durability, one of these parameters can be improved only at the sacrifice of other parameters.

SUMMARY OF THE INVENTION

Therefore, an object of the present invention is to provide a solid golf ball which is improved in feeling while maintaining the superior flying performance and durability which are characteristic of solid golf balls, that is, improved in total balance.

In connection with a solid golf ball having a core forming the center and a cover forming the outermost layer, the inventors have found that by providing a soft intermediate layer between the center core and the cover, and controlling the thickness and specific gravity of the core, intermediate layer and cover, the center core can be made relatively soft to improve feeling without deteriorating flying performance and durability. The hitting feel can be improved in a favorable way.

Briefly stated, an intermediate layer having a thickness of at least 1 mm, a specific gravity of less than 1.2, and a hardness of less than 80 on JIS C scale is formed around a center core having a diameter of at least 26 mm and a specific gravity of less than 1.4 and a cover having a thickness of 1 to 3 mm is formed on the outer surface of the intermediate layer to complete a solid golf ball. Then even when the center core is softened to a JIS C scale hardness of 80 or less, the feeling can be improved at no sacrifice of flying distance and durability. Further when the intermediate layer is formed of a resin composition based on a thermoplastic elastomer, especially thermo-plastic polyester elastomer, the hitting feel can be further improved at no sacrifice of flying distance and durability.

The present invention provides a three-piece solid golf ball comprising a center core, an intermediate layer, and a cover wherein the center core has a diameter of at least 26 mm and a specific gravity of less than 1.4, the intermediate layer has a thickness of at least 1 mm, a specific gravity of less than 1.2, and a hardness of less than 80 on JIS C scale, and the cover has a thickness of 1 to 3 mm.

BRIEF DESCRIPTION OF THE DRAWING

The only FIGURE.

DETAILED DESCRIPTION OF THE INVENTION

Figure 1:
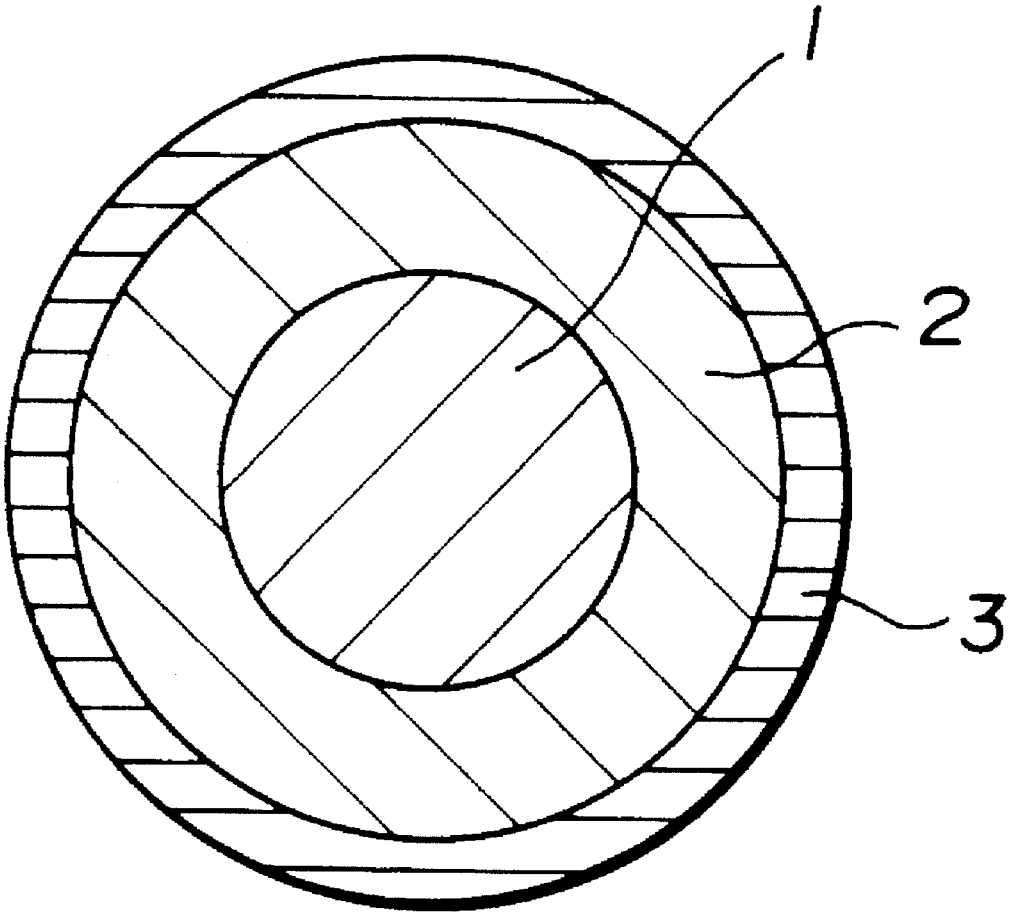
FIG. 1 is a schematic cross section of a three-piece solid golf ball according to the invention.

Referring to FIG. 1, there is schematically illustrated a typical three-piece solid golf ball according to the invention. The ball includes a spherical center core 1 forming the center of the ball and a cover 3 forming the outermost layer of the ball. A soft intermediate layer 2 is disposed between the core 1 and the cover 3. The size and specific gravity of the core 1, intermediate layer 2, and cover 3 are set in specific ranges.

The center core has a diameter of at least 26 mm, preferably 27 to 37 mm and a specific gravity of less than 1.4, preferably 1 to 1.35. With a diameter of less than 26 mm, feeling is not fully improved by making the center core 1 to be soft and the ball is substantially reduced in elastic repulsion so that the flying distance is reduced. With a specific gravity of 1.4 or more, the ball has a heavier weight which exceeds the weight requirement of golf balls.

On an impact entailing substantial deformation as found on driver shots, the player gets a feeling which largely depends on the hardness of the center core 1 and varies with the club head speed given by the player. Therefore, the hardness of the center core 1 should be set in accordance with the head speed of the target players. In this sense, the center core hardness is not particularly limited although it preferably ranges up to 80, more preferably from 40 to 75 on JIS C scale (at the center core surface).

The center core 1 is generally formed from a well-known rubber composition comprising a base rubber, co-crosslinking agent and peroxide through heating, pressing and molding steps. The base rubber may be one conventionally used in solid golf balls and preferably be selected from polybutadiene rubber and mixtures of polybutadiene rubber and polyisoprene rubber. Use of 1,4-polybutadiene rubber containing more than 90% of cis structure is preferred for high repulsion. The co-crosslinking agents used in conventional solid golf balls include zinc and magnesium salts of unsaturated fatty acids such as methacrylic acid and acrylic acid and esters of unsaturated fatty acids such as trimethylpropane trimethacrylate and they may be used in the present invention. Zinc acrylate is preferred for high repulsion. The co-crosslinking agent is blended in amounts of about 10 to 27 parts by weight per 100 parts by weight of the base rubber. The peroxide may be selected from a variety of peroxides, preferably dicumyl peroxide and mixtures of dicumyl peroxide and 1,1,-bis(t-butylperoxy)-3,3,5-trimethylcyclohexane. The peroxide is blended in amounts of about 0.5 to 1 parts by weight per 100 parts by weight of the base rubber. If desired, zinc oxide and barium sulfate may be blended in the rubber composition for specific gravity adjustment while antioxidants may also be blended.

The intermediate layer 2 has a radial thickness of at least 1 mm, preferably at least 1.3 mm, a specific gravity of less than 1.2, preferably 0.9 to 1.19, and a hardness of less than 80, preferably 45 to 75 on JIS C scale. With a thickness of less than 1 mm, repulsion is lowered to reduce flying distance. With a specific gravity of 1.2 or more, the ball has a heavier weight which exceeds the weight requirement of golf balls. With a JIS C scale hardness of 80 or higher, feeling becomes poor.

The intermediate layer 2 is effective in compensating for lowering repulsion of the center core 1 which is made soft. It is then formed of a soft (JIS C scale hardness<80), repulsive material. Although the material is not critical, thermoplastic elastomers and mixtures of thermoplastic elastomer and ionomer resin are preferred. While the thermoplastic elastomers include polyester and polyamide elastomers, the thermoplastic polyester elastomers are most preferred.

The thermoplastic polyester elastomers are polyether ester multi-block copolymers which are synthesized from terephthalic acid, 1,4-butane diol, and polytetramethylene glycol (PTMG) or polypropylene glycol (PPG) so that the polybutylene terephthalate (PBT) portion forms hard segments and the polytetramethylene glycol (PTGM) or polypropylene glycol (PPG) forms soft segments. For example, Hytrel 4047 and G3548W are commercially available from Toray-dupont K.K.

Examples of the ionomer resin which can be mixed with the thermoplastic elastomer include relatively high repulsion Himilan 1605 and 1707 commercially available from Mitsui-dupont Polychemical K.K. Usually 0 to 50 parts by weight of the ionomer resin is mixed with 100 parts by weight of the thermoplastic elastomer.

In addition to the thermoplastic elastomer and ionomer resin,, the composition of which the intermediate layer is formed may further contain weight control agents, for example, inorganic fillers such as zinc oxide and barium sulfate, coloring agents such as titanium dioxide, and other additives.

The cover 3 has a radial thickness of 1 to 3 mm, preferably 1.5 to 2.5 mm. A cover of more than 3 mm thick is low in repulsion and feeling whereas a cover of less than 1 mm thick is low in durability such as cut resistance. Although the hardness of the cover 3 is not particularly limited, it is preferably 85 or higher, more preferably 85 to 100 on JIS C scale. A cover with a hardness of less than 85 would be less repulsive.

The cover 3 is generally formed of an ionomer resin which is conventionally used as the cover of solid golf balls. Exemplary ionomer resins are Himilan 1706 and 1605 commercially available from Mitsui-dupont Polychemical K.K.

EXAMPLE

Examples of the present invention are given below by way of illustration and not by way of limitation..

Examples and Comparative Examples

Using a center core, intermediate layer, and cover having the composition shown in Table 1, three-piece solid golf balls (Examples 1–7, Comparative Examples 1–2) and two-piece solid golf balls (Comparative Examples 3–4) were prepared which had the parameters and test properties shown in Table 2.

The center core and the core of the two-piece ball were prepared by kneading the respective components in a roll mill and pressure molding at 155° C. for 15 minutes. The intermediate layer was formed by injection molding so as to enclose the outer surface of the center core. The cover was formed around the intermediate layer or the outer surface of the two-piece ball core by injection molding. The solid golf balls were completed in this way.

The golf balls were evaluated for flying performance, feeling, and durability by the following tests.

Flying Performance

Using a swing robot manufactured by True Temper Co., the ball was hit by a driver at a head speed of 45 m/s and 35 m/s (abbreviated as HS45 and HS35 in Table 2, respectively) to measure the flying distance.

Feeling

Professional golfers evaluated a feeling on impact according to the following criterion.

○: good

Δ: average

X: Poor

Durability

Using a flywheel hitting machine, the ball was repeatedly hit at a head speed of 38 m/s until the ball was broken. With the number of hits counted, the ball was rated according to the following criterion.

○: good

Δ: average

X: poor

TABLE 1

| | Example | | | | | | | Comparative Example | | | |
|---|---|---|---|---|---|---|---|---|---|---|---|
| | 1 | 2 | 3 | 4 | 5 | 6 | 7 | 1 | 2 | 3 | 4 |
| Center core | | | | | | | | | | | |
| Cis-1,4-polybutadiene | 100 | 100 | 100 | 100 | 100 | 100 | 100 | 100 | 100 | 100 | 100 |
| Zinc acrylate | 25 | 25 | 15 | 25 | 25 | 25 | 25 | 25 | 25 | 15 | |
| Zinc oxide | 52 | 34 | 37 | 26 | | 25 | 25 | 75 | 33 | 29 | |

TABLE 1-continued

| | Example | | | | | | | Comparative Example | | | |
|---|---|---|---|---|---|---|---|---|---|---|---|
| | 1 | 2 | 3 | 4 | 5 | 6 | 7 | 1 | 2 | 3 | 4 |
| Antioxidant | 0.2 | 0.2 | 0.2 | 0.2 | 0.2 | 0.2 | 0.2 | 0.2 | 0.2 | 0.2 | |
| Dicumyl peroxide | 0.65 | 0.65 | 0.65 | 0.65 | 0.65 | 0.65 | 0.65 | 0.65 | 0.65 | 0.65 | |
| Intermediate layer | | | | | | | | | | | |
| Hytrel 4047 | 100 | 100 | 100 | 100 | 100 | | 80 | 100 | | | |
| Hytrel G3548W | | | | | | 100 | | | | | |
| Himilan 1605 | | | | | | | 20 | | | | |
| Himilan 1650 | | | | | | | | | 50 | | |
| Surlyn 8120 | | | | | | | | | 50 | | |
| Cover | | | | | | | | | | | |
| Himilan 1706 | 50 | 50 | 50 | 50 | 50 | 50 | 50 | 50 | 50 | 50 | 50 |
| Himilan 1605 | 50 | 50 | 50 | 50 | 50 | 50 | 50 | 50 | 50 | 50 | 50 |

Note: The amount of components blended are parts by weight and their proportion is independent among the center core, intermediate layer, and cover.

TABLE 2

| | Example | | | | | | | Comparative Example | | | |
|---|---|---|---|---|---|---|---|---|---|---|---|
| | 1 | 2 | 3 | 4 | 5 | 6 | 7 | 1 | 2 | 3 | 4 |
| Center core | | | | | | | | | | | |
| Outer diameter, mm | 27.68 | 31.52 | 31.57 | 35.24 | 36.40 | 31.56 | 31.56 | 23.80 | 31.57 | 38.58 | 38.60 |
| Hardness, JIS C | 73 | 73 | 53 | 73 | 73 | 73 | 73 | 73 | 73 | 53 | 81 |
| Specific gravity | 1.32 | 1.25 | 1.24 | 1.19 | 1.03 | 1.18 | 1.18 | 1.46 | 1.35 | 1.18 | 1.16 |
| Intermediate layer | | | | | | | | | | | |
| Thickenss, mm | 5.3 | 3.5 | 3.5 | 1.8 | 1.8 | 3.5 | 3.4 | 7.1 | 3.5 | | |
| Hardness, JIS C | 61 | 61 | 61 | 61 | 61 | 50 | 68 | 61 | 82 | | |
| Specific gravity | 1.10 | 1.10 | 1.10 | 1.10 | 1.10 | 1.18 | 1.18 | 1.10 | 0.97 | | |
| Cover | | | | | | | | | | | |
| Thickness, mm | 2.2 | 2.1 | 2.1 | 1.9 | 2.0 | 2.1 | 2.2 | 2.4 | 2.1 | 2.0 | 2.0 |
| Hardness, JIS C | 91 | 91 | 91 | 89 | 91 | 91 | 91 | 91 | 91 | 91 | 89 |
| Sepcific gravity | 0.95 | 0.95 | 0.95 | 0.98 | 0.95 | 0.95 | 0.95 | 0.95 | 0.95 | 0.95 | 0.98 |
| Performance | | | | | | | | | | | |
| W1 HS45 carry, m | 208.0 | 209.0 | 209.0 | 210.5 | 210.0 | 209.0 | 210.0 | 205.0 | 209.0 | 208.0 | 210.0 |
| total, m | 220.5 | 220.0 | 221.5 | 222.5 | 220.0 | 221.0 | 222.0 | 218.0 | 221.0 | 220.0 | 220.0 |
| W1 HS35 carry, m | 141.0 | 141.0 | 142.0 | 141.0 | 142.0 | 142.5 | 141.5 | 139.0 | 141.0 | 141.0 | 139.5 |
| total, m | 147.5 | 148.0 | 148.5 | 148.0 | 148.5 | 149.0 | 148.5 | 145.0 | 148.0 | 148.0 | 145.5 |
| Feeling | ○ | ○ | ○ | ○ | ○ | ○ | ○ | ○ | X | ○ | X |
| Durability | ○ | ○ | ○ | ○ | ○ | ○ | ○ | ○ | ○ | X | ○ |

As is evident from Table 2, the three-piece solid golf balls of the present invention have a good balance of properties in that the center core can be made soft to ensure a pleasant feeling without deteriorating flying performance and durability.

There has been described a three-piece solid golf ball which includes a core, intermediate layer and cover having controlled size, hardness and specific gravity so that the ball has a good total balance of properties in that a relatively soft center core is used to ensure a pleasant feeling at no sacrifice of flying performance and durability.

Japanese Patent Application No. 5-193064 is incorporated herein by reference.

Although a preferred embodiment has been described, many modifications and variations may be made thereto in the light of the above teachings. It is therefore to be understood that within the scope of the appended claims, the invention may be practiced otherwise than as specifically described.

We claim:

1. A three-piece solid golf ball comprising; a center core, an intermediate layer, and a cover enclosing the core through the intermediate layer, said center core formed of a polybutadiene base rubber and having a diameter of at least 26 mm, a specific gravity of less than 1.4, and a hardness up to 80 on JIS C scale, said intermediate layer formed of a thermoplastic polyester elastomer and having a thickness of at least 1 mm, a specific gravity of less than 1.2, and a hardness of less than 80 on JIS C scale, and said cover having a thickness of 1 to 3 mm, and a hardness of at least 85 on JIS C scale.

2. The golf ball of claim 1, wherein said center core has a diameter in the range of 27 to 37 mm.

3. The golf ball of claim 1, wherein said center core has a specific gravity in the range of 1 to 1.35.

4. The golf ball of claim 1, wherein said center core has a hardness in the range of 40 to 75 on JIS C scale.

5. The golf ball of claim 1, wherein said intermediate layer has a thickness of at least 1.3 mm.

6. The golf ball of claim 1, wherein said intermediate layer has a specific gravity in the range of 0.9 to 1.19.

7. The golf ball of claim 1, wherein said intermediate layer has a hardness in the range of 45 to 75 on JIS C scale.

8. The golf ball of claim 1, wherein said cover has a thickness in the range of 1.5 to 2.5 mm.

9. The golf ball of claim 1, wherein said cover has a hardness in the range of 85 to 100 on JIS C scale.

* * * * *